US009677489B2

(12) United States Patent
Schwarz et al.

(10) Patent No.: US 9,677,489 B2
(45) Date of Patent: Jun. 13, 2017

(54) METHOD AND CONTROL UNIT FOR STARTING AN OTTO ENGINE

(71) Applicant: Robert Bosch GmbH, Stuttgart (DE)

(72) Inventors: Hans-Friedrich Schwarz, Muehlacker (DE); Peter Schenk, Ludwigsburg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 539 days.

(21) Appl. No.: 13/850,716

(22) Filed: Mar. 26, 2013

(65) Prior Publication Data

US 2013/0275029 A1 Oct. 17, 2013

(30) Foreign Application Priority Data

Mar. 26, 2012 (DE) ..... 10 2012 204 758

(51) Int. Cl.
*F02D 41/06* (2006.01)
*F02D 41/38* (2006.01)
(Continued)

(52) U.S. Cl.
CPC ..... *F02D 41/062* (2013.01); *F02D 19/0655* (2013.01); *F02D 19/085* (2013.01); *F02D 41/0025* (2013.01); *F02D 41/3076* (2013.01); *F02D 41/3845* (2013.01); *F02D 41/3863* (2013.01); *F02D 41/064* (2013.01); *F02D 41/403* (2013.01); *F02D 2200/0602* (2013.01); *F02D 2250/31* (2013.01)

(58) Field of Classification Search
CPC ..... F02D 41/062; F02D 41/0025; F02D 41/3845; F02D 41/3023; F02D 41/064; F02D 41/3076; F02D 41/401; F02D 41/3818; F02D 41/402; F02D 41/3011; F02D 41/3863; F02D 2200/0602; F02D 2200/6011; F02D 2200/0689; F02D 19/085; F02D 19/027; F02D 19/0605; F02D 19/0649; F02D 19/0655
USPC ..... 123/453, 457, 179.12
See application file for complete search history.

(56) References Cited

U.S. PATENT DOCUMENTS 5,179,926 A * 1/1993 Ament ..... 123/494
5,190,001 A * 3/1993 Dieter et al. ..... 123/179.15
(Continued)

FOREIGN PATENT DOCUMENTS

EP 0 961 019 12/1999

*Primary Examiner* — Thomas Moulis
*Assistant Examiner* — George Jin
(74) *Attorney, Agent, or Firm* — Gerard Messina

(57) ABSTRACT

A method and control unit for a start of an Otto engine operated at low temperatures, using ethanol and/or gasoline, having direct injection. The method includes generating by a high pressure pump a fuel pressure in a high pressure system connected to a high pressure reservoir; a sensor monitoring the fuel pressure in the reservoir and the system; injecting the fuel, by an injector, from the reservoir into a cylinder of the engine, the fuel pressure, an injection quantity and a fuel quantity being specified by a control unit based on, sensor the fuel pressure being specified based on the operating point of the engine up to an upper pressure which is below a starting pressure to which the fuel is increased before the fuel injection, and the fuel pressure in the reservoir and the system being limited to a maximum by an opening pressure of a limiting valve.

8 Claims, 1 Drawing Sheet

(51) Int. Cl.

| | |
|---|---|
| ***F02D 19/06*** | (2006.01) |
| ***F02D 19/08*** | (2006.01) |
| ***F02D 41/30*** | (2006.01) |
| ***F02D 41/00*** | (2006.01) |
| *F02D 41/40* | (2006.01) |

(56) References Cited

U.S. PATENT DOCUMENTS

| | | | | |
|---|---|---|---|---|
| 5,785,031 | A * | 7/1998 | Akimoto et al. | 123/295 |
| 6,145,490 | A * | 11/2000 | Heidenfelder et al. | 123/295 |
| 2004/0094126 | A1* | 5/2004 | Hasegawa et al. | 123/447 |
| 2005/0155568 | A1* | 7/2005 | Maitani | 123/295 |
| 2005/0193982 | A1* | 9/2005 | Sakai et al. | 123/431 |
| 2006/0060162 | A1* | 3/2006 | Fukui et al. | 123/179.16 |
| 2006/0075992 | A1* | 4/2006 | Akita et al. | 123/431 |
| 2008/0135015 | A1* | 6/2008 | Kapus | 123/299 |
| 2008/0154485 | A1* | 6/2008 | Yasuda et al. | 701/113 |
| 2010/0294236 | A1* | 11/2010 | Surnilla et al. | 123/304 |
| 2011/0000463 | A1* | 1/2011 | Kokotovic et al. | 123/457 |
| 2011/0162622 | A1* | 7/2011 | Kojima et al. | 123/457 |
| 2012/0318237 | A1* | 12/2012 | Tsukagoshi et al. | 123/445 |
| 2014/0172274 | A1* | 6/2014 | Douglas | 701/104 |
| 2014/0299103 | A1* | 10/2014 | Yanoto | 123/447 |

* cited by examiner

METHOD AND CONTROL UNIT FOR STARTING AN OTTO ENGINE

RELATED APPLICATION INFORMATION

The present application claims priority to and the benefit of German patent application no. 10 2012 204 758.1, which was filed in Germany on Mar. 26, 2012, the disclosure of which is incorporated herein by reference.

FIELD OF THE INVENTION

The present invention relates to a method for carrying out the high pressure start of an Otto engine using direct injection, a fuel pressure in a high pressure system having a high pressure reservoir being generated by a high pressure pump; the fuel pressure in the high pressure reservoir and the high pressure system connected to it being measured using a high pressure sensor; the fuel being injected from the high pressure reservoir via at least one fuel injector into at least one cylinder of the Otto engine; the fuel pressure, an injection quantity and a conveyed fuel quantity being specified by a control unit as a function of the signal of the high pressure sensor supplied to the control unit, the fuel pressure being specified as a function of the operating point of the Otto engine up to an upper system pressure; and the fuel pressure in the high pressure reservoir and in the high pressure system being limited to a maximum pressure by an opening pressure of a pressure limiting valve. The present invention also relates to a control unit for controlling an Otto engine having direct injection, the control unit being connected to a high-pressure pump for generating a fuel pressure in a high-pressure system having a high-pressure reservoir, having a high-pressure sensor for determining the fuel pressure in the high-pressure system and being connected to at least one fuel injector for dosing a fuel quantity injected into at least one cylinder of the Otto engine; the control unit being configured for setting the fuel pressure in a range up to an upper system pressure; and the high-pressure system having a pressure-limiting valve that has an opening pressure for limiting the fuel pressure to a maximum pressure.

BACKGROUND INFORMATION

In Otto engines having direct injection, the fuel pressure is set as a function of the operating point of the Otto engine, up to a specified upper system pressure. In this context, the pressure range typically lies between 40 bar as the lower system pressure, and 200 bar as the upper one.

The fuel system of such an Otto engine may include a high-pressure system having a high-pressure reservoir (common rail). The generation of the required fuel pressure takes place, for example, by a high-pressure pump configured as a piston pump, which is driven mechanically by the Otto engine. The conveyed fuel quantity of the high-pressure pump is set by a quantity control valve that is set ahead of the high-pressure pump. The fuel pressure in the high-pressure system is measured by a high-pressure sensor and is supplied to a control unit. The control unit regulates the fuel pressure as a function of the operating point of the Otto engine by the corresponding actuation of the quantity control valve.

The fuel dosing into the individual cylinders of the Otto engine takes place by fuel injectors that are also actuated by the control unit.

A pressure limiting valve is provided, so that, in a fault case, for example, which causes a maximum delivery of the high-pressure pump, an admissible maximum system pressure is not exceeded. The pressure-limiting valve opens in response to a specified opening pressure, for instance, 250 bar, and enables a return flow of the fuel from the high-pressure system back into the low-pressure range of the fuel system before the high-pressure pump. The fuel pressure in the high-pressure system is thus limited to a maximum pressure corresponding to the opening pressure of the pressure-limiting valve.

The cold start of an Otto engine having direct injection may take place as a low-pressure start or as a high-pressure start. Thus, in European document EP 0 961 019 E1, a method is discussed for operating a direct-injecting internal combustion engine during the start, the internal combustion engine being able to be started optionally using a homogeneous or stratified operation, and for this, predetermined engine control parameters being calculated for the homogeneous and the stratified operation, as a function of the variable (TKW) characterizing the temperature of the internal combustion engine a selection being made between the operation using a homogeneous mixture and a stratified mixture, and in an operation using the stratified mixture, the injection being specified by the parameters injection quantity (MFF) and angle of injection (EOI). In the process, it is provided that the operation using the stratified mixture is only released when the fuel pressure (PRail) has reached a specified threshold value (P_THR) within a certain number of cycles of the internal combustion engine, and otherwise the operation using an homogeneous mixture is selected. The operation having the stratified mixture corresponds to a high-pressure start, while the operation having the homogeneous mixture represents a low-pressure start.

Advantages of the high-pressure start are the low quantity of fuel injected, reduced oil dilution as well as lower requirements on the configuration of the injector valves, since the static rate of flow Qstat is reduced, and the accuracy in dosing small quantities is increased thereby.

In a high-pressure start, the high pressure is built up as soon as the Otto engine begins to revolve, until a fixed pressure threshold is exceeded. Then there follows the injection and the ignition, and the engine starts. Typical pressure thresholds for the injection release lie between 20 bar and 80 bar, as a function of temperature. Before the main injection using ignition, a preinjection may be provided as high-pressure injection or low-pressure injection.

Otto engines are generally operated using fuel of hydrocarbons from fossil fuels based on refined petroleum, and to this fuel there is increasingly being added alcohol produced from renewable raw materials (plants), such as ethanol or methanol, in different mixture ratios. The ethanol proportion in fuel mixtures lies in a wider spread of 0% to 85%, depending on the market; in various countries, operation using pure alcohol is provided too. In the USA and Europe, a mixture is often used of 75-85% ethanol and 15-25% gasoline under the brand name E85. By taking on pure gasoline, all possible fuel compositions below an 85% ethanol proportion are thereby able to set in.

The cold start of an Otto engine having direct injection sets high requirements on the injection system in response to the use of a fuel mixture of gasoline and alcohol, even at temperatures between 10° C. and 20° C. Because of poor mixture preparation and the low inclination of alcohol to evaporate at low temperatures, the injection of a considerably larger quantity is required, compared to when the engine is hot. This increases the consumption and the emission of undesired exhaust gas components. At temperatures below 5° C., in the case of pure ethanol as the fuel, a reliable start is not possible without additional measures. Such additional measures may be heated injector valves or the additional injection of gasoline via a separate injection system, which means, however, a clear increase in costs in the manufacture of the injection system.

SUMMARY OF THE INVENTION

It is therefore an object of the exemplary embodiments and/or exemplary methods of the present invention to provide a method and a control unit which make possible a reliable start of Otto engines having direct fuel injection at low temperatures without the additional measures that increase the cost.

The object of the exemplary embodiments and/or exemplary methods of the present invention relating to the device may be attained in that, at a start of the Otto engine before the release of the injection of the fuel into the at least one cylinder of the Otto engine, the fuel pressure in the high-pressure system is increased to a starting pressure, which lies between the upper system pressure and the maximum pressure. Direct injections for Otto engines operate using a maximum pressure of 250 bar and an operating point-dependent system pressure of 40 to 200 bar. The starting pressure, at which the injection is released, lies between 20 and 80 bar. However, at a start at low environmental temperature, this is not enough for a sufficient mixture preparation. At operation using gasoline at below −30° C. and at operation using a high proportion of ethanol or methanol at below 10° C. to 20° C., additional measures have to be taken at the start. By additional preinjection or an increase in the injection quantity, however, consumption increases, and fuel is transferred into the engine oil, in an undesired manner. In operation using pure alcohol, heated injectors may be required or an additional injection of gasoline. Because of the method according to the present invention, such additional measures may drop out, and thus costs may be saved. In addition, the transfer of fuel into the engine oil may be avoided.

If the starting pressure amounts to at least 85% of the maximum pressure, and thus, at a maximum pressure of 250 bar at least 212 bar, the atomization of the fuel, and, with that, the fuel preparation is considerably improved.

The mixture preparation is able to be further improved in that, during the buildup of the fuel pressure, a predetermined quantity of fuel is injected into the at least one cylinder. In this instance, the preinjection may take place as a low-pressure injection or a high-pressure injection.

In one further refinement of the method, it is provided that a starting pressure between the upper system pressure and the maximum pressure be provided if the temperature of the fuel or of the Otto engine or of the cooling arrangement of the Otto engine is below a specified temperature threshold, and that a starting pressure below the upper system, pressure, which may be in a range between 20 bar and 80 bar be provided if the temperature lies above the specified temperature threshold.

Depending upon the environmental conditions at the start, such an optimal operating manner of the Otto engine is able to be selected.

The start of the Otto engine using direct injection may be further improved if the temperature threshold and/or the starting pressure are specified as a function of a composition of a fuel mixture used as fuel. In an operation using gasoline, the temperature threshold may be fixed, for example, at 40° C., while in an operation using pure alcohol it may be fixed at 10° to 20° C. In operation using fuel mixtures, besides the temperature threshold, the starting pressure may additionally be adjusted. Additional measures currently required, such as heated injectors or an additional gasoline injection at an operation using E100 may be omitted.

The object of the exemplary embodiments and/or exemplary methods of the present invention related to the device is attained in that, for a cold start, a program routine is provided in the control unit for increasing the fuel pressure above the upper system pressure and below the maximum pressure. The broadening and the supplementation of the control unit by the program routine according to the present invention is a cost-effective design approach and makes unnecessary additional devices, such as heated injection nozzles for the operation of the Otto engine having direct injection using a fuel mixture having a high proportion of alcohol.

A particularly suitable embodiment of the control unit for carrying out the method provides that, in the control unit, there be present data on the fuel mixture to be used as fuel, that the control unit also have available the temperature of the fuel and/or of the Otto engine and/or a cooling arrangement of the Otto engine, and that in the control unit there be stored specified values for the fuel pressure to be set, as a function of the composition of the fuel mixture and/or the temperature.

The method or the control unit are particularly suitable for improving the start in an Otto engine which is operated using alcohol or using a mixture of alcohol and gasoline.

The exemplary embodiments and/or exemplary methods of the present invention are explained in greater detail below with reference to an exemplary embodiment shown in the figures.

DETAILED DESCRIPTION

Figure 1:
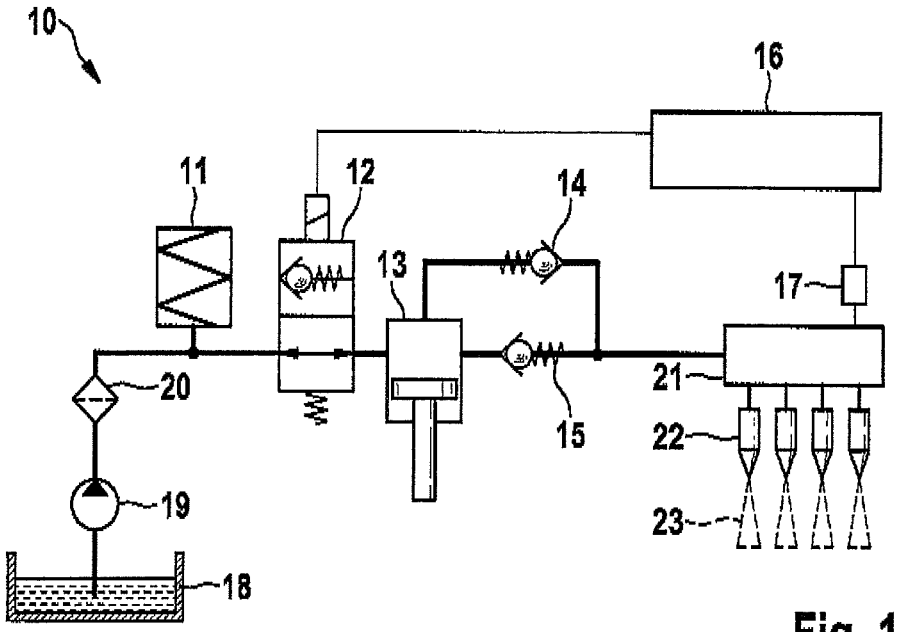
FIG. 1 shows a system for a direct injection device for an Otto engine.

FIG. 1 shows a direct injection device 10 for an Otto engine. A fuel mixture of gasoline and alcohol is supplied from a fuel container 18 via a filter 20 using a pump 19 to a quantity control valve 12. A damper 11 minimizes pressure fluctuations in the system. Quantity control valve 12 is actuated by a control unit 16 according to requirements, so that the pressure provided via a high-pressure pump 13 is sufficient for the operating conditions of the Otto engine. High-pressure pump 13, via a check valve 15, supplies a high-pressure reservoir 21 (common rail) with fuel which is dosed via fuel injectors 22 using a nozzle in the cylinder of the Otto engine, in the form of a fuel-spray fog 23. The fuel pressure in high-pressure reservoir 21 is monitored by a high-pressure sensor 17, whose output signal is supplied to control unit 16. A program routine in control unit 16 may thus, for instance, be based on the signal of high-pressure sensor 17, using quantity control valve 12, set the pressure in high-pressure reservoir 21 and also release the injection at the start. In normal operation, as a function of the operating point, the fuel pressure is thus set in a range of 40 to 200 bar. The pressure in the high-pressure system, to which high-pressure reservoir 21 also belongs, is additionally monitored and limited by a pressure-limiting valve 14. The latter takes care that, in the case of a malfunction, the pressure in the system does not rise above the maximum admissible value of 250 bar, for example.

According to the exemplary embodiments and/or exemplary methods of the present invention, a program routine is provided in control unit 16 which, at the start of the Otto engine, at a low temperature, is able to set, via quantity control valve 12 and high-pressure pump 13, a pressure in high-pressure reservoir 21 above the pressure range in normal operation, but below the maximum admissible value.

Figure 2:
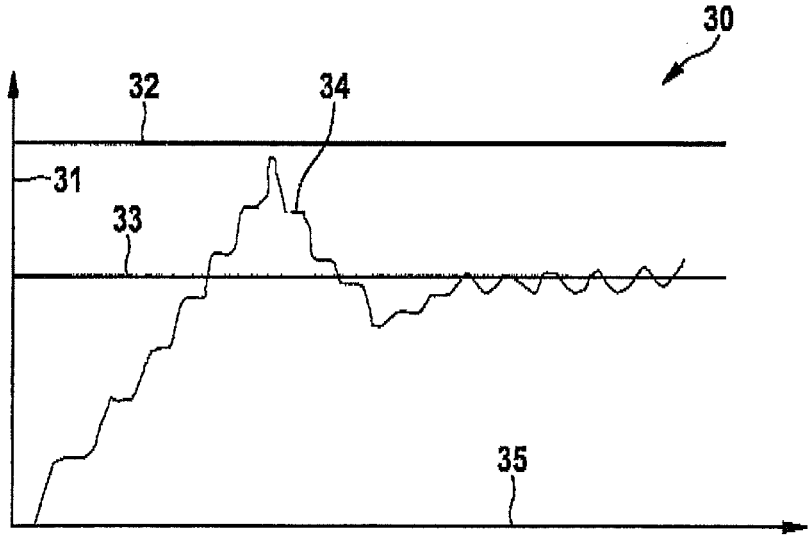
FIG. 2 shows a pressure curve for a high-pressure start of an Otto engine.

FIG. 2 shows a pressure diagram 30 at the start of an Otto engine having direct injection, at a low system temperature. In pressure diagram 30, along a time axis 35 and a pressure axis 31 a pressure curve 34 is drawn in, as is measured at the start in high-pressure reservoir 21 of FIG. 1 using high-pressure sensor 17. After the start, pressure curve 34 exceeds a system pressure 33, which lies typically in a range below 200 bar, but remains below an opening pressure 32 for pressure limiting valve 14. At the highest value of pressure curve 34, an injection is released and the Otto engine is started. After that, pressure curve 34 is regulated to a range about system pressure 33.

What is claimed is:

1. A method for carrying out a high-pressure start of an Otto engine having direct injection, the method comprising:

increasing, at a start of the Otto engine, before a release of an injection of fuel into at least one cylinder of the Otto engine, the fuel pressure in the high-pressure system to a starting pressure, which lies between an upper system pressure and a maximum pressure;

wherein a fuel pressure in a high-pressure reservoir of a high pressure system is generated by a high-pressure pump, wherein the fuel pressure in the high-pressure reservoir of the high-pressure system are measured using a high-pressure sensor, wherein the fuel is injected from the high pressure reservoir via at least one fuel injector into at least one cylinder of the Otto engine, wherein the fuel pressure, an injection quantity and a conveyed fuel quantity are specified by a control unit as a function of a signal of the high pressure sensor supplied to the control unit, wherein the fuel pressure is specified as a function of an operating point of the Otto engine up to an upper system pressure, wherein the fuel pressure in the high-pressure reservoir and in the high-pressure system is limited to a maximum pressure by an opening pressure of a pressure limiting valve, wherein the starting pressure is at least about 85% of the maximum pressure, and wherein a starting pressure between the upper system pressure and the maximum pressure is provided if the temperature of the fuel or of the Otto engine or of the cooling arrangement of the Otto engine lies below a specified temperature threshold, and a starting pressure below the upper system pressure is provided if the temperature lies above the specified temperature threshold.

2. The method of claim 1, wherein during a buildup of the fuel pressure by a preinjection, a predetermined quantity of fuel is injected into the at least one cylinder.

3. The method of claim 1, wherein at least one of the temperature threshold and the starting pressure is specified as a function of a composition of a fuel mixture used as fuel.

4. A control unit for controlling an Otto engine having direct injection, comprising:

a control unit arrangement connected to a high-pressure pump to generate a fuel pressure in a high-pressure system having a high-pressure reservoir, having a high-pressure sensor for determining the fuel pressure in the high-pressure system and having at least one fuel injector for dosing a fuel quantity injected into at least one cylinder of the Otto engine, wherein the control unit arrangement is configured for setting the fuel pressure in a range up to an upper system pressure, and wherein the high-pressure system has a pressure-limiting valve having an opening pressure for limiting the fuel pressure to a maximum pressure;

wherein the control unit arrangement is configured to increase, at a start of the Otto engine, before a release of an injection of fuel into at least one cylinder of the Otto engine, the fuel pressure in the high-pressure system to a starting pressure, wherein the control unit arrangement includes, for a cold start, a program routine for increasing the fuel pressure above the upper system pressure and below the maximum pressure, wherein the starting pressure of the is at least about 85% of the maximum pressure, and wherein a starting pressure between the upper system pressure and the maximum pressure is provided if the temperature of the fuel or of the Otto engine or of the cooling arrangement of the Otto engine lies below a specified temperature threshold, and a starting pressure below the upper system pressure is provided if the temperature lies above the specified temperature threshold.

5. The control unit of claim 4, wherein, in the control unit, there are present data on the composition of a fuel mixture used as fuel, wherein the control unit has available the temperature of at least one of the fuel, the Otto engine, and a cooling arrangement of the Otto engine, and wherein in the control unit there are stored specified values for the fuel pressure to be set, as a function of the composition of at least one of the fuel mixture and the temperature.

6. The control unit of claim 4, wherein the Otto engine is operated using one of alcohol and a mixture of alcohol and gasoline.

7. The method of claim 1, wherein the Otto engine is operated using one of alcohol and a mixture of alcohol and gasoline.

8. The method of claim 1, wherein the upper system pressure is in a range between 20 bar and 80 bar.

* * * * *